US009941072B1

(12) United States Patent
Chen et al.

(10) Patent No.: US 9,941,072 B1
(45) Date of Patent: Apr. 10, 2018

(54) KEYBOARD DEVICE

(71) Applicant: Primax Electronics Ltd., Taipei (TW)

(72) Inventors: Bo-An Chen, Taipei (TW); Hsien-Tsan Chang, Taipei (TW); Yi-Chen Wang, Taipei (TW); Chen-Hsuan Hsu, Taipei (TW); Chin-Sung Pan, Taipei (TW); Ming-Han Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/450,437

(22) Filed: Mar. 6, 2017

(30) Foreign Application Priority Data

Dec. 14, 2016 (TW) ..... 105141379 A

(51) Int. Cl.

| | |
|---|---|
| ***H01H 13/83*** | (2006.01) |
| ***H01H 13/70*** | (2006.01) |
| ***H01H 13/14*** | (2006.01) |
| *H01H 3/12* | (2006.01) |
| *H01H 13/705* | (2006.01) |

(52) U.S. Cl.
CPC ..... *H01H 13/70* (2013.01); *H01H 13/14* (2013.01); *H01H 13/83* (2013.01); *H01H 3/125* (2013.01); *H01H 13/705* (2013.01)

(58) Field of Classification Search
CPC ..... H01H 3/125; H01H 13/83; H01H 13/705; H01H 13/14; H01H 13/70; H01H 9/26; H01H 13/72; H01H 25/00; H01H 25/04; H01H 1/02
USPC ..... 200/5 A, 344, 314, 345, 512, 312, 511, 200/245, 288; 400/490, 491, 491.2, 400/495.1, 496
See application file for complete search history.

(56) References Cited

U.S. PATENT DOCUMENTS

| | | | | |
|---|---|---|---|---|
| 5,901,837 | A * | 5/1999 | Aimi | H01H 3/125 200/344 |
| 6,781,077 | B2 * | 8/2004 | Olodort | H01H 3/125 200/344 |
| 2011/0297525 | A1 * | 12/2011 | Tsai | H01H 13/705 200/517 |
| 2013/0220786 | A1 * | 8/2013 | Niu | H01H 3/125 200/344 |
| 2014/0014488 | A1 * | 1/2014 | Tsai | H01H 13/88 200/5 A |
| 2015/0083562 | A1 * | 3/2015 | Hsu | H01H 13/14 200/344 |

* cited by examiner

*Primary Examiner* — Ahmed Saeed
(74) *Attorney, Agent, or Firm* — Muncy, Geissler, Olds & Lowe, P.C.

(57) ABSTRACT

A keyboard device includes a key structure, a switch circuit board, a base plate, a soft covering element and a buffering pad. The key structure includes a keycap and a stabilizer bar. The stabilizer bar is connected with the keycap and the soft covering element. The soft covering element is disposed on the base plate. An accommodation space is defined by the soft covering element and the base plate collaboratively. The stabilizer bar is inserted into the accommodation space, so that the stabilizer bar is connected with the base plate. The buffering pad is disposed on the base plate and partially received within the accommodation space. The stabilizer bar and the base plate are made of metallic material. Since the stabilizer bar and the base plate are separated by the soft covering element and the buffering pad, the keyboard device is capable of reducing noise.

9 Claims, 13 Drawing Sheets

KEYBOARD DEVICE

FIELD OF THE INVENTION

The present invention relates to an input device, and more particularly to a keyboard device with plural key structures.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices. The subject of the present invention is related to a keyboard device.

FIG. 1 is a schematic top view illustrating the outer appearance of a conventional keyboard device. As shown in FIG. 1, plural key structures 10 and 10' are disposed on a top surface of the conventional keyboard device 1. The key structures 10 have the ordinary sizes. The key structures 10' are relatively longer. That is, the length of the key structure 10 is slightly larger than the width of the key structure 10, and the length L1 of the key structure 10' is much larger than the width W1 of the key structure 10'. When one of the key structures 10 and 10' is depressed by the user's finger, a corresponding key signal is generated to the computer, and thus the computer executes a function corresponding to the depressed key structure. Generally, the user may depress the key structures 10 and 10' to input corresponding English letters (or symbols) or numbers or execute various functions (e.g., F1~F12 or Delete). For example, the conventional keyboard device 1 is a keyboard for a notebook computer.

The structures of the conventional keyboard device will be illustrated as follows. FIG. 2 is a schematic exploded view illustrating a portion of the conventional keyboard device and taken along a viewpoint. FIG. 3 is a schematic exploded view illustrating a portion of the conventional keyboard device and taken along another viewpoint. Please refer to FIGS. 1, 2 and 3. The conventional keyboard device 1 comprises plural key structures 10 and 10', a metallic base plate 11 and a membrane circuit board 12. The membrane circuit board 12 comprises plural membrane switches 121 corresponding to the plural key structures 10 and 10'. Each of the plural key structures 10 and 10' comprises a keycap 101, at least one scissors-type connecting element 102 and a rubbery elastomer 103. The scissors-type connecting element 102 is connected between the keycap 101 and the metallic base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The rubbery elastomer 103 is arranged between the keycap 101 and the metallic base plate 11. Moreover, the rubbery elastomer 103 comprises a contacting part 1031.

While the keycap 101 of any key structure 10 or 10' is depressed and moved downwardly relative to the metallic base plate 11, the first frame 1021 and the second frame 1022 of the scissors-type connecting element 102 are switched from an open-scissors state to a stacked state. Moreover, as the keycap 101 is moved downwardly to compress the rubbery elastomer 103, the corresponding membrane switch 121 is pushed and triggered by the contacting part 1031 of the rubbery elastomer 103. Consequently, the membrane circuit board 12 generates a corresponding key signal. When the keycap 101 of the key structure 10 or 10' is no longer depressed, the keycap 101 is moved upwardly relative to the metallic base plate 11 in response to an elastic force of the rubbery elastomer 103. Meanwhile, the first frame 1021 and the second frame 1022 are switched from the stacked state to the open-scissors state again, and the keycap 101 is returned to its original position.

In the keyboard device 1, the key structures 10' and the key structures 10 are distinguished. As shown in the drawings, the length L1 of the key structure 10' is much larger than the width W1 of the key structure 10'. Since the length L1 of the keycap 101 of the key structure 10' is relatively longer, the keycap 101 is readily rocked while the key structure 10' is depressed. That is, the operating smoothness of the key structure 10' is adversely affected, and even the tactile feel of the user is impaired. For increasing the operating smoothness of the key structure 10', the key structure 10' is further equipped with a special mechanism. For example, the key structure 10' further comprises a first stabilizer bar 104 and a second stabilizer bar 105. The first stabilizer bar 104 comprises a first linking bar part 1041 and two first hook parts 1042. The two first hook parts 1042 are located at two ends of the first stabilizer bar 104, respectively. The second stabilizer bar 105 comprises a second linking bar part 1051 and two second hook parts 1052. The two second hook parts 1052 are located at two ends of the second stabilizer bar 105, respectively.

The metallic base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first linking bar part 1041 of the first stabilizer bar 104 and the second linking bar part 1051 of the second stabilizer bar 105 are pivotally coupled to the keycap 101 of the key structure 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively.

FIG. 4 is a schematic perspective view illustrating a portion of the combination of the metallic base plate and the membrane circuit board of the conventional keyboard device. FIG. 5 schematically illustrates the actions of the first stabilizer bar and the second stabilizer bar of the conventional keyboard device. Please refer to FIGS. 4 and 5. While the keycap 101 of the key structure 10' is moved upwardly or downwardly relative to the metallic base plate 11, the first stabilizer bar 104 is moved in a first direction D11 or a second direction D12 and rotated in a first rotating direction D13 or a second rotating direction D14. Similarly, the second stabilizer bar 105 is moved in the first direction D11 or the second direction D12 and rotated in the first rotating direction D13 or the second rotating direction D14. By the first stabilizer bar 104 and the second stabilizer bar 105, the key structure 10' is kept stable and not inclined while the key structure 10' is moved upwardly or downwardly relative to the metallic base plate 11. Moreover, the uses of the first stabilizer bar 104 and the second stabilizer bar 105 are helpful to increase the strength of the keycap 101.

However, the conventional keyboard device 1 still has some drawbacks. For example, all of the first stabilizer bar 104, the second stabilizer bar 105 and the metallic base plate 11 are made of metallic material. Please refer to FIGS. 4 and 5. While the keycap 101 of the key structure 10' is moved upwardly or downwardly relative to the metallic base plate 11 and the first stabilizer bar 104 and the second stabilizer bar 105 are correspondingly moved and rotated, the two first hook parts 1042 of the first stabilizer bar 104 and the two second hook parts 1052 of the second stabilizer bar 105 are readily contacted with the metallic base plate 11. While the two first hook parts 1042 and the two second hook parts 1052 collide with the metallic base plate 11, a click sound is generated. Especially when the R corners of the two first hook parts 1042 and the two second hook parts 1052 (e.g., the regions indicated by oblique lines of FIG. 5) collide with the metallic base plate 11, the click sound is generated. This sound is unpleasant noise to the user.

Therefore, there is a need of providing a keyboard device with reduced noise.

SUMMARY OF THE INVENTION

An object of the present invention provides a keyboard device with reduced noise.

In accordance with an aspect of the present invention, there is provided a keyboard device. The keyboard device includes a key structure, a switch circuit board, a base plate, a soft covering element and a buffering pad. The key structure includes a keycap and a stabilizer bar. The keycap is exposed outside the keyboard device. The stabilizer bar is connected with the keycap. The stabilizer bar includes a linking bar part and a hook part. The linking bar part is connected with the keycap. The hook part is located at an end of the linking bar part. The switch circuit board is located under the key structure. When the switch circuit board is triggered, a key signal is generated. The base plate is located under the switch circuit board, and supports the key structure. The soft covering element is disposed on the base plate. An accommodation space is defined by the soft covering element and the base plate collaboratively. The hook part is inserted into the accommodation space, so that the hook part is permitted to be moved within the accommodation space. The buffering pad is disposed on the base plate and partially received within the accommodation space. The hook part and the base plate are separated from each other through the buffering pad.

In accordance with another aspect of the present invention, there is provided a keyboard device. The keyboard device includes a key structure, a switch circuit board, a base plate, a light-emitting element, a light guide plate and a soft covering element. The key structure includes a keycap and a stabilizer bar. The keycap is exposed outside the keyboard device. The stabilizer bar is connected with the keycap. The stabilizer bar includes a linking bar part and a hook part. The linking bar part is connected with the keycap. The hook part is located at an end of the linking bar part. The switch circuit board is located under the key structure. When the switch circuit board is triggered, a key signal is generated. The base plate is located under the switch circuit board, and supports the key structure. The light-emitting element emits a light beam. The light guide plate is located under the base plate and arranged beside the light-emitting element. The light beam is guided to the key structure by the light guide plate. The soft covering element is disposed on the light guide plate. An accommodation space is defined by the soft covering element and the light guide plate collaboratively. The hook part is inserted into the accommodation space. Consequently, the hook part is permitted to be moved within the accommodation space.

From the above descriptions, the present invention provides the keyboard device. The soft covering elements are disposed on the top surface of the base plate or the light guide plate. The first hook parts and the second hook parts are separated from the base plate through the soft covering elements. The first coupling parts and the second coupling parts that are made of the metallic material and used in the conventional keyboard device are replaced by the soft covering elements according to the present invention. The soft covering elements are made of the soft material. Even if the first hook parts and the second hook parts are made of the metallic material, the first hook parts and the second hook parts are only contacted with the soft covering elements but not contacted with the metallic material. That is, the metallic components do not collide with the base plate to generate the unpleasant noise. Consequently, the keyboard device of the present invention is capable of reducing the noise.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the drawbacks of the conventional technologies, the present invention provides a keyboard device. First of all, the structure of the keyboard device will be illustrated as follows.

Figure 1:
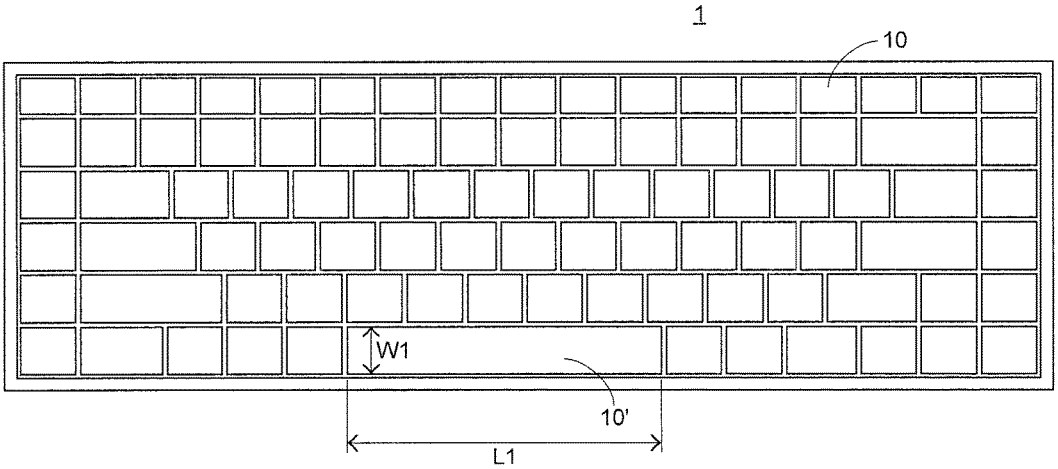
FIG.1 PRIOR ART
FIG. 1 is a schematic top view illustrating the outer appearance of a conventional keyboard device.
Figure 2:
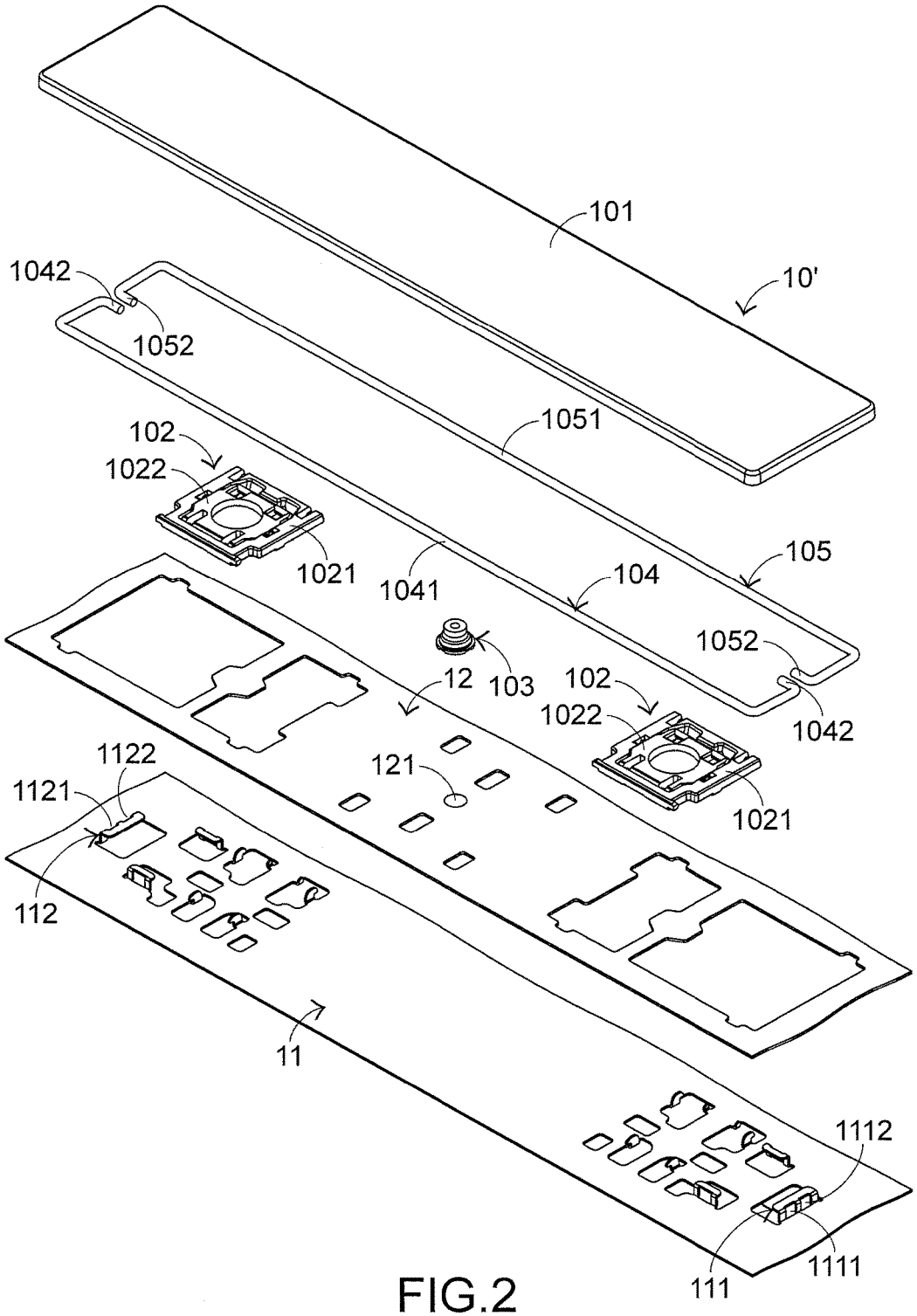
FIG.2 PRIOR ART
FIG. 2 is a schematic exploded view illustrating a portion of the conventional keyboard device and taken along a viewpoint.
Figure 3:
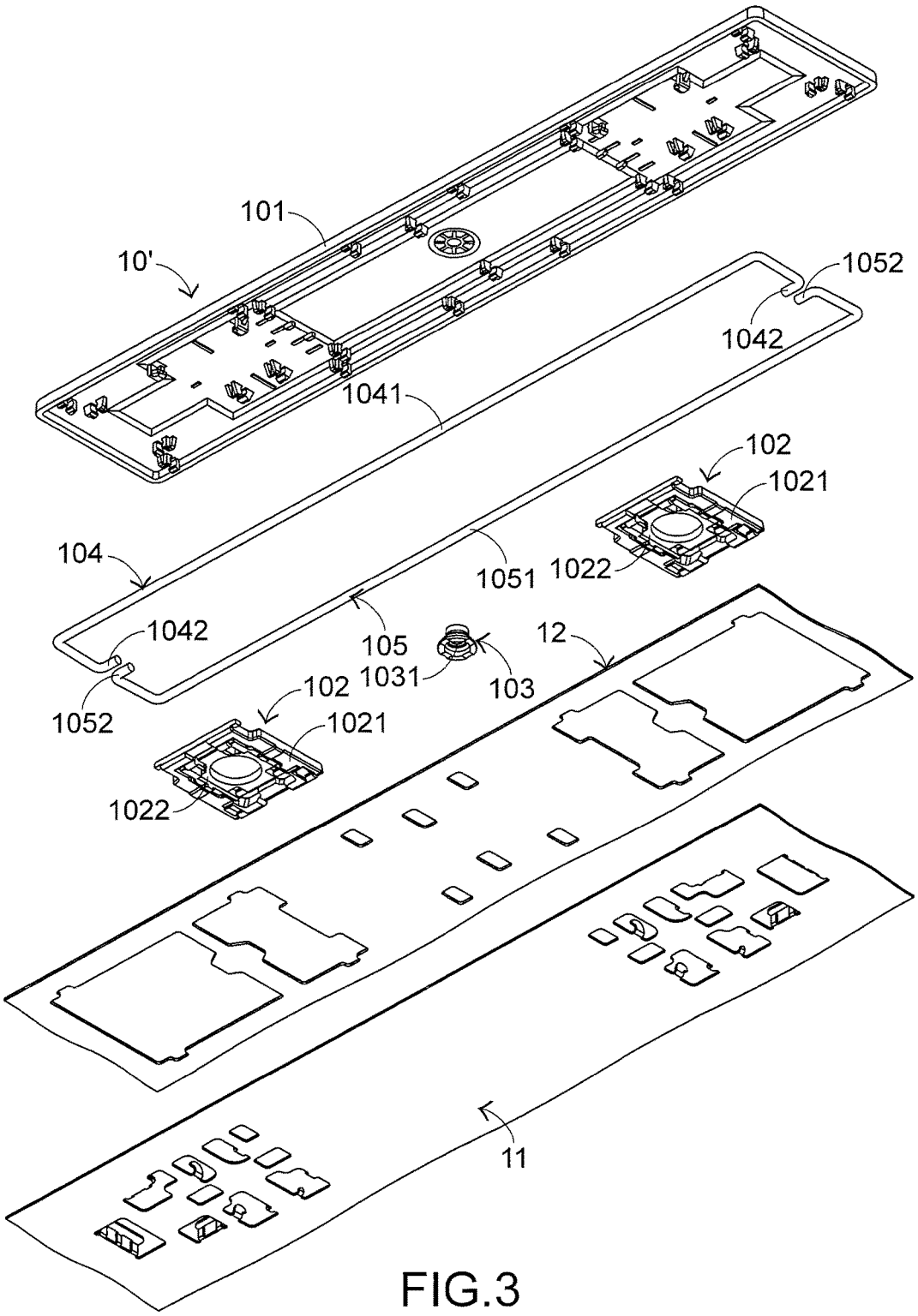
FIG.3 PRIOR ART
FIG. 3 is a schematic exploded view illustrating a portion of the conventional keyboard device and taken along another viewpoint.
Figure 4:
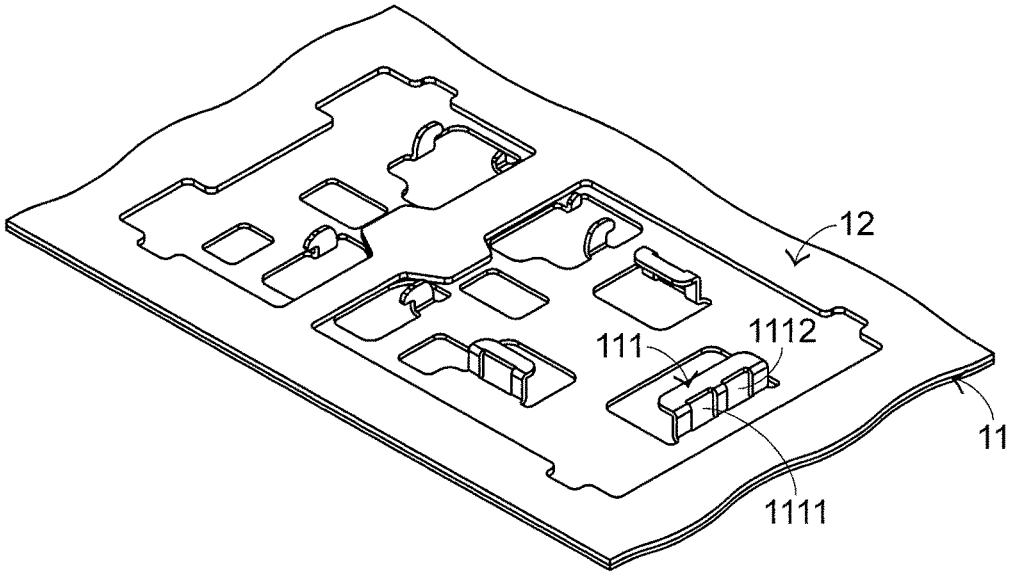
FIG.4 PRIOR ART
FIG. 4 is a schematic perspective view illustrating a portion of the combination of the metallic base plate and the membrane circuit board of the conventional keyboard device.
Figure 5:
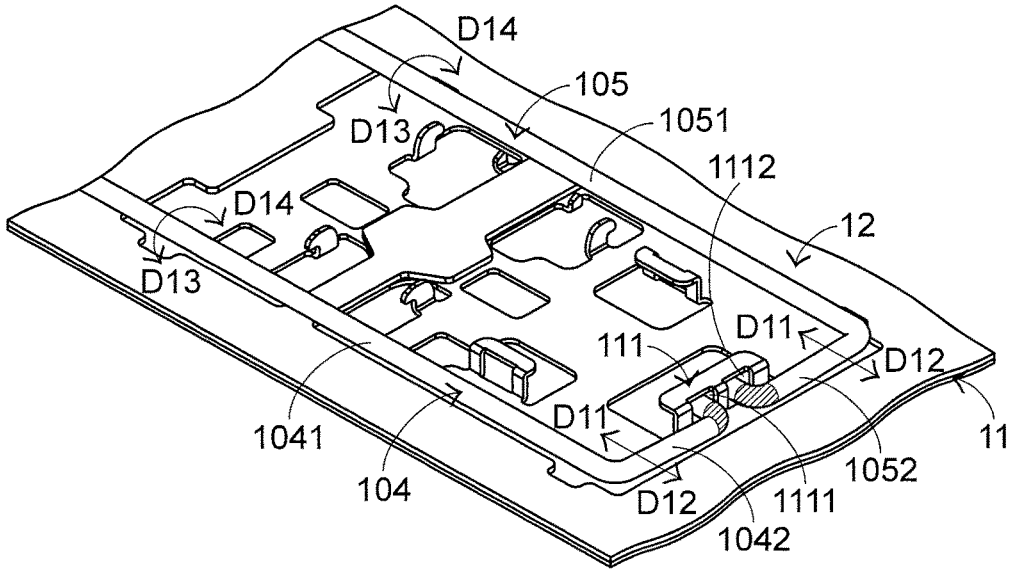
FIG.5 PRIOR ART
FIG. 5 schematically illustrates the actions of the first stabilizer bar and the second stabilizer bar of the conventional keyboard device.
Figure 6:
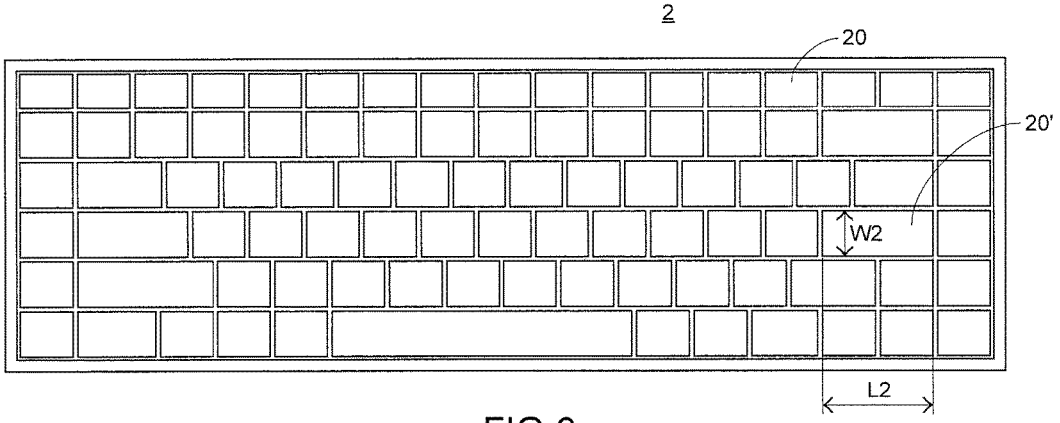
FIG. 6 is a schematic top view illustrating the outer appearance of a keyboard device according to a first embodiment of the present invention.

FIG. 6 is a schematic top view illustrating the outer appearance of a keyboard device according to a first embodiment of the present invention. The keyboard device 2 comprises plural key structures 20 and 20'. These key structures 20 and 20' are exposed outside the keyboard device 2. When one of the key structures 20 and 20' is depressed by the user's finger, a corresponding key signal is generated to a computer (not shown) that is in communication with the keyboard device 2. Consequently, the computer executes a function corresponding to the depressed key structure. The length of the key structure 20 is slightly larger than the width of the key structure 20. The length L2 of the key structure 20' is much larger than the width W2 of the key structure 20'.

Figure 7:
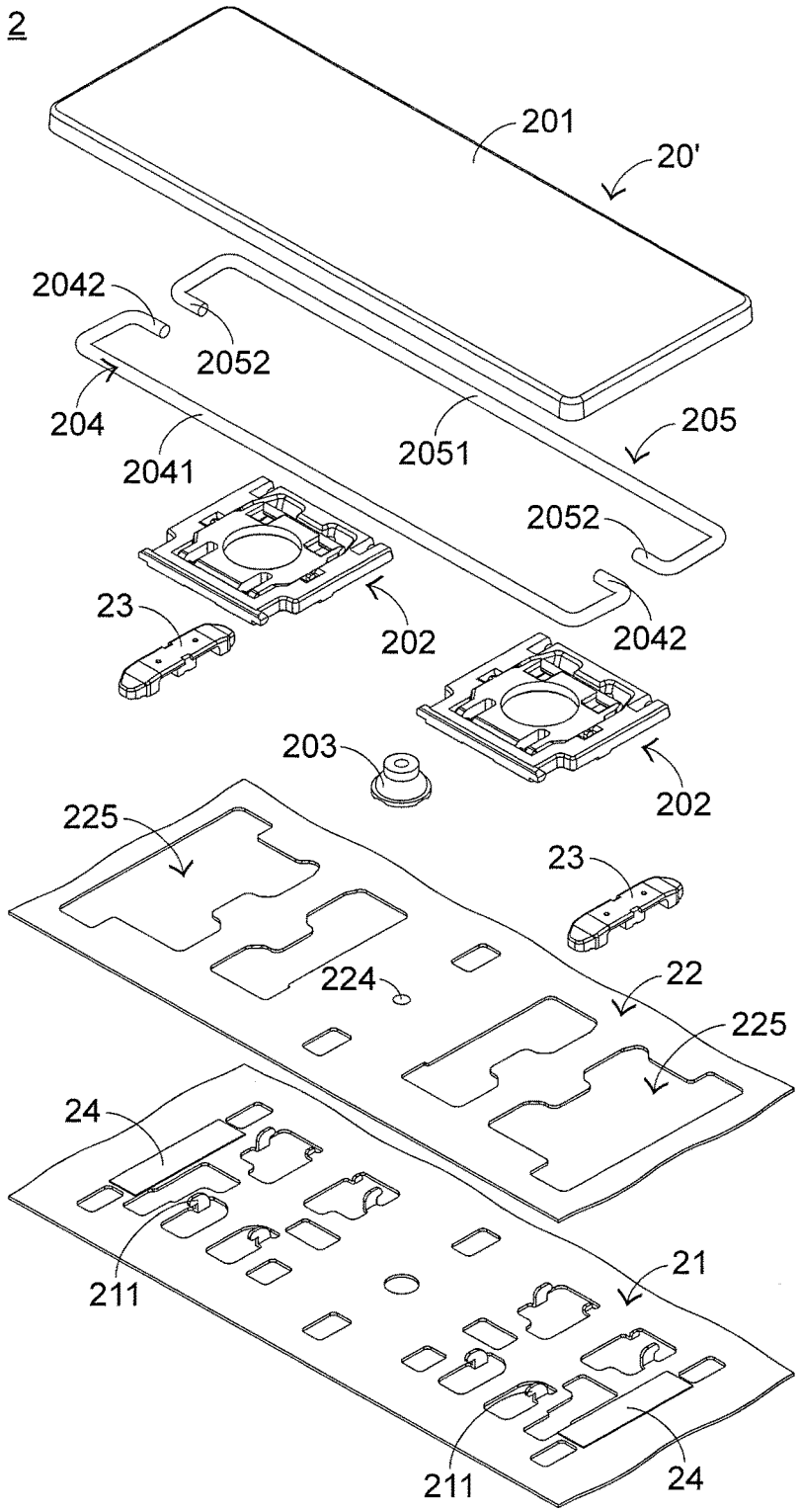
FIG. 7 is a schematic exploded view illustrating a portion of the keyboard device according to the first embodiment of the present invention and taken along a viewpoint.
Figure 8:
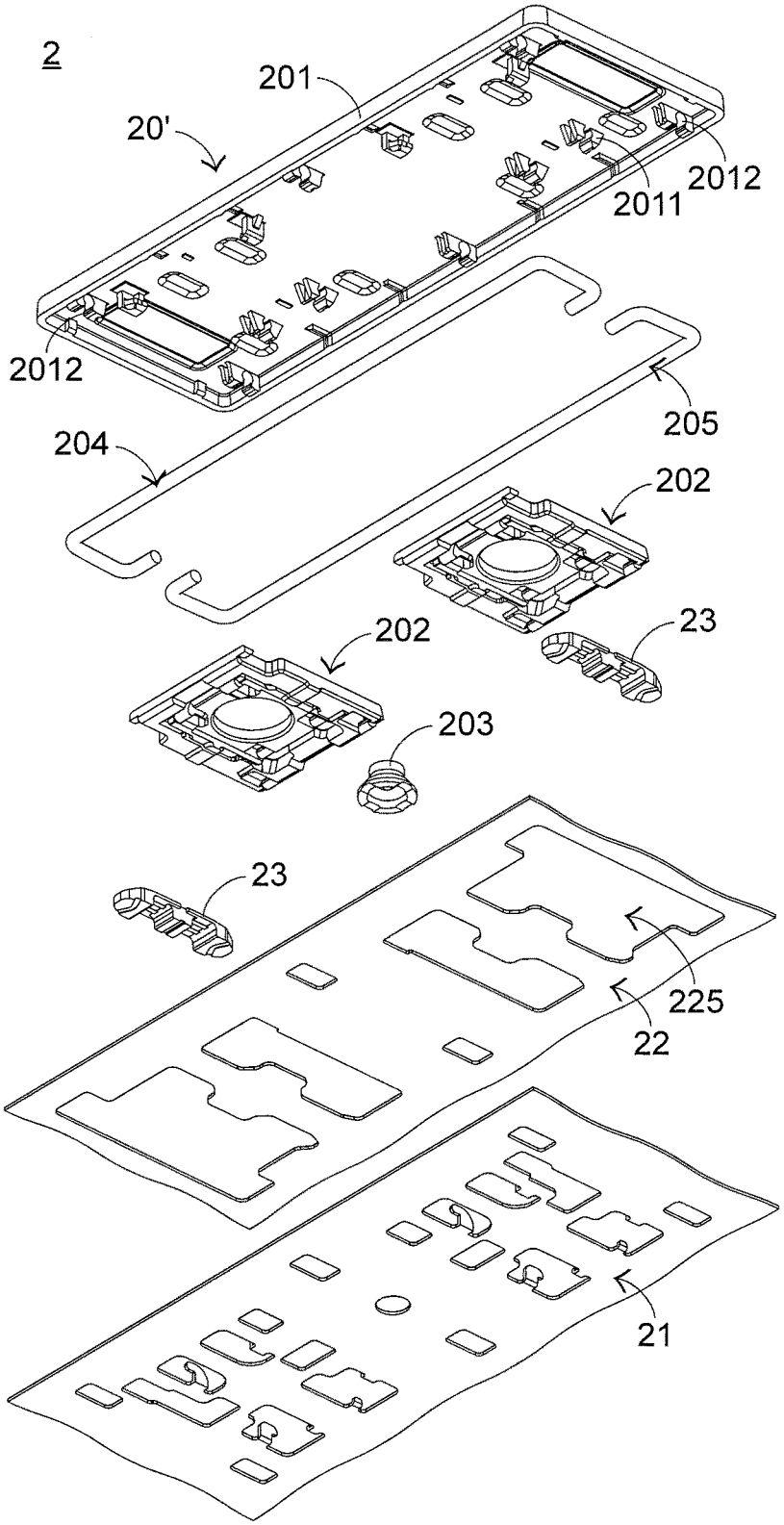
FIG. 8 is a schematic exploded view illustrating a portion of the keyboard device according to the first embodiment of the present invention and taken along another viewpoint.
Figure 9:
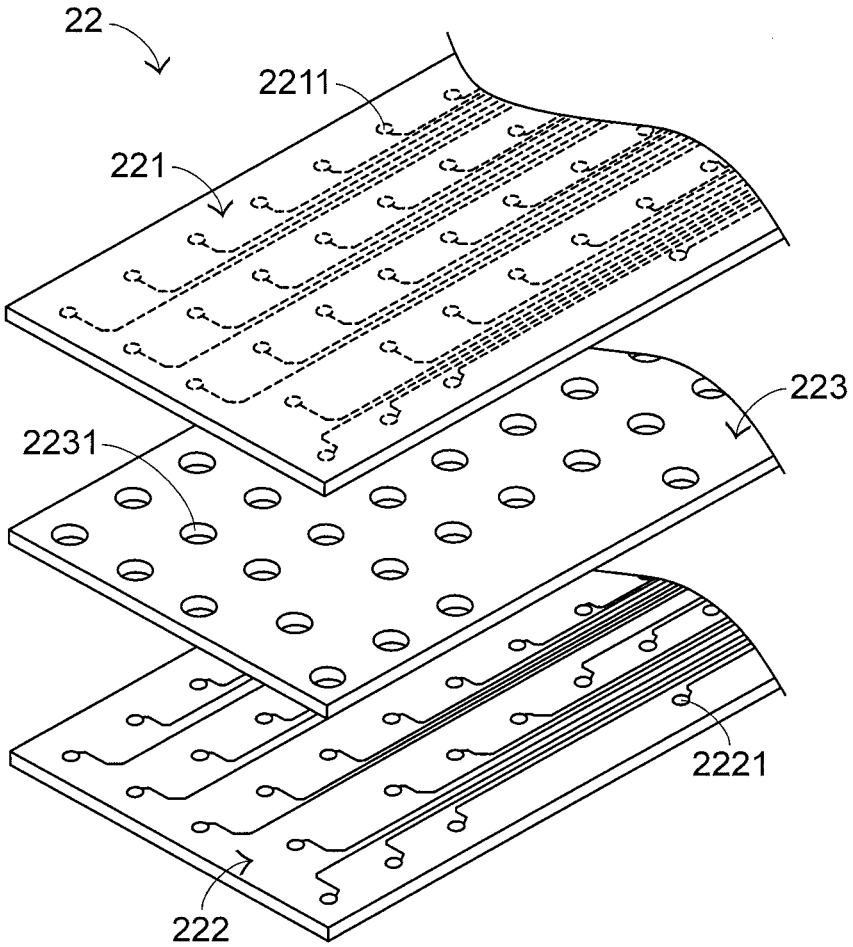
FIG. 9 is a schematic exploded view illustrating a portion of the switch circuit board of the keyboard device according to the first embodiment of the present invention and taken along another viewpoint.

Hereinafter, the inner structure of the keyboard device 2 will be illustrated with reference to FIGS. 7, 8 and 9. FIG. 7 is a schematic exploded view illustrating a portion of the keyboard device according to the first embodiment of the present invention and taken along a viewpoint. FIG. 8 is a schematic exploded view illustrating a portion of the keyboard device according to the first embodiment of the present invention and taken along another viewpoint. FIG. 9 is a schematic exploded view illustrating a portion of the switch circuit board of the keyboard device according to the first embodiment of the present invention and taken along another viewpoint. In addition to the plural key structures 20 and 20', the keyboard device 2 further a base plate 21, a switch circuit board 22, soft covering elements 23 and buffering pads 24. The base plate 21 is located under the plural key structures 20 and 20' and connected with the plural key structures 20 and 20'. The switch circuit board 22 is arranged between the plural key structures 20, 20' and the base plate 21. When the switch circuit board 22 is triggered by one of the plural key structures 20 and 20', a corresponding key signal is generated. The switch circuit board 22 comprises an upper wiring plate 221, a lower wiring plate 222, a separation layer 223, a key switch 224 and plural openings 225. Each of the key structures 20' comprises a keycap 201, at least one scissors-type connecting element 202, an elastic element 203, a first stabilizer bar 204 and a second stabilizer bar 205. The scissors-type connecting element 202 is connected with the corresponding keycap 201 and the base plate 21. Through the scissors-type connecting element 202, the keycap 201 is fixed on the base plate 21 and moved relative to the base plate 21. The elastic element 203 is arranged between the corresponding keycap 201 and the switch circuit board 22, and aligned with the corresponding key switch 224. When the elastic element 203 is pushed by the keycap 201, the corresponding key switch 224 is triggered. In an embodiment, the base plate 21 is made of a metallic material, the elastic element 203 is a rubbery elastomer, and the scissors-type connecting element 202 is made of a plastic material.

Please refer to FIGS. 7 and 8. Both of the first stabilizer bar 204 and the second stabilizer bar 205 are connected with the keycap 201. The first stabilizer bar 204 comprises a first linking bar part 2041 and two first hook parts 2042. The first linking bar part 2041 is connected with the keycap 201. The two first hook parts 2042 are located at two ends of the first stabilizer bar 204, respectively. Similarly, the second stabilizer bar 205 comprises a second linking bar part 2051 and two second hook parts 2052. The second linking bar part 2051 is connected with the keycap 201. The two second hook parts 2052 are located at two ends of the second stabilizer bar 205, respectively. The base plate 21 comprises plural base plate hooks 211. The plural base plate hooks 211 are connected with the scissors-type connecting element 202 in order to fix the scissors-type connecting element 202 on the base plate 21. Moreover, the keycap 201 comprises plural first coupling parts 2011 and plural second coupling parts 2012. The plural first coupling parts 2011 are disposed on an inner surface of the keycap 201 and connected with the scissors-type connecting element 202. The plural second coupling parts 2012 are also are disposed on the inner surface of the keycap 201. Moreover, the plural second coupling parts 2012 are connected with the first linking bar part 2041 and the second linking bar part 2051.

The upper wiring plate 221 of the switch circuit board 22 comprises an upper circuit pattern 2211. In addition, the upper circuit pattern 2211 is formed on a bottom surface of the upper wiring plate 221. The lower wiring plate 222 is located under the upper wiring plate 221. The lower wiring plate 222 comprises a lower circuit pattern 2221. In addition, the lower circuit pattern 2221 is formed on a top surface of the lower wiring plate 222. The separation layer 223 is arranged between the upper wiring plate 221 and the lower wiring plate 222. In addition, the separation layer 223 comprises plural perforations 2231 corresponding to the plural keycaps 201. The upper circuit pattern 2211 and the lower circuit pattern 2221 are separated from each other through the separation layer 223. Moreover, plural key switches 224 are defined by the upper circuit pattern 2211, the plural perforations 2231 and the lower circuit pattern 2221 collaboratively. Each key switch 224 is aligned with the corresponding key structure 20 or 20'. When the key switch 224 is triggered by the corresponding key structure 20 or 20', the corresponding key signal is generated.

Figure 10:
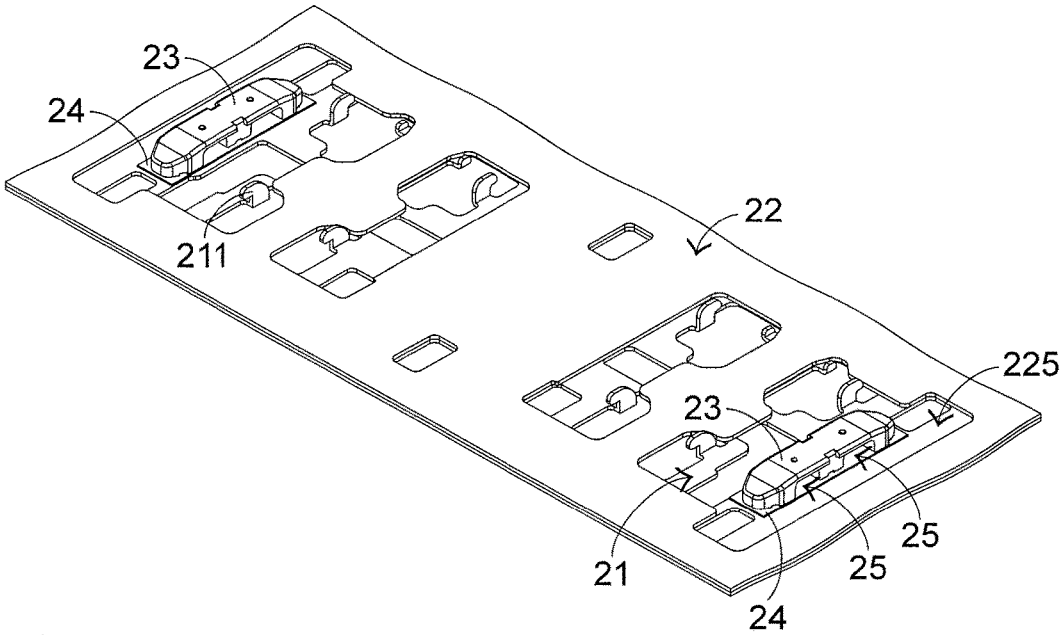
FIG. 10 is a schematic perspective view illustrating a portion of the combination of the base plate and the switch circuit board of the keyboard device according to the first embodiment of the present invention.

FIG. 10 is a schematic perspective view illustrating a portion of the combination of the base plate and the switch circuit board of the keyboard device according to the first embodiment of the present invention. Please refer to FIGS. 7 and 10. The soft covering elements 23 are disposed on the base plate 21. Moreover, plural accommodation spaces 25 are defined by the soft covering elements 23 and the base plate 21. The first hook parts 2042 and the second hook parts 2052 are inserted into the corresponding accommodation spaces 25. Consequently, the first hook parts 2042 and the second hook parts 2052 are permitted to be moved within the accommodation spaces 25. The soft covering elements 23 are adhered on the top surface of the base plate 21. The buffering pads 24 are disposed on the top surface of the base plate 21 and partially received within the accommodation spaces 25. The first hook parts 2042 and the second hook parts 2052 are separated from the base plate 21 through the buffering pads 24. Since the first hook parts 2042 and the second hook parts 2052 are not contacted with the base plate 21, the first hook parts 2042 and the second hook parts 2052 do not collide with the base plate 21 to generate the unpleasant noise. In this embodiment, the accommodation spaces 25 are through-holes. That is, the first hook parts 2042 and the second hook parts 2052 are penetrated through the corresponding accommodation spaces 25. The soft covering elements 23 are made of polysiloxane or polymerized siloxane (i.e., silicone resin) or a soft plastic material. The buffering pads 24 are made of a soft material or a plastic material.

The operations of depressing the key structure 20' will be described as follows. While the keycap 201 of any key structure 20' is depressed, the keycap 201 is moved downwardly relative to the base plate 21. Since the scissors-type connecting element 202 is pushed by the keycap 201, the scissors-type connecting element 202 is correspondingly swung. Moreover, as the keycap 201 is moved downwardly to push the elastic element 203, the elastic element 203 is subjected to deformation to trigger the corresponding key switch 224. Consequently, the corresponding key signal is generated. When the key structure 20' is no longer depressed, the keycap 201 is moved upwardly relative to the base plate 21 in response to a restoring elastic force of the elastic element 203. As the keycap 201 is moved upwardly, the scissors-type connecting element 202 is correspondingly swung and switched from the stacked state to the open-scissors state again. Consequently, the keycap 201 is returned to its original position.

Figure 11:
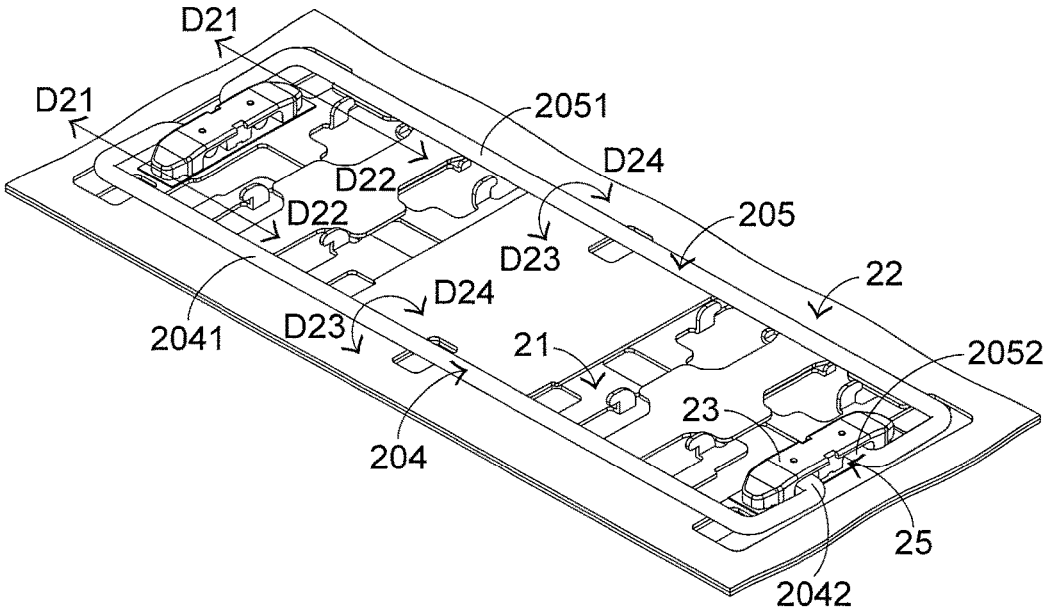
FIG. 11 schematically illustrates the actions of the first stabilizer bar and the second stabilizer bar of the keyboard device according to the first embodiment of the present invention.

FIG. 11 schematically illustrates the actions of the first stabilizer bar and the second stabilizer bar of the keyboard device according to the first embodiment of the present invention. While the keycap 201 of the key structure 20' is moved upwardly or downwardly relative to the base plate 21, the first stabilizer bar 204 is moved in a first direction D21 or a second direction D22 and rotated in a first rotating direction D23 or a second rotating direction D24. Moreover, the first linking bar part 2041 of the first stabilizer bar 204 is rotated relative to the corresponding second coupling parts 2012, and the two first hook parts 2042 are rotated within the corresponding accommodation spaces 25. During rotation, the first hook parts 2042 are not contacted with the base plate 21. Similarly, the second stabilizer bar 205 is moved in the first direction D21 or the second direction D22 and rotated in the first rotating direction D23 or the second rotating direction D24. Moreover, the second linking bar part 2051 of the second stabilizer bar 205 is rotated relative to the corresponding second coupling parts 2012, and the two second hook parts 2052 are rotated within the corresponding accommodation spaces 25. During rotation, the second hook parts 2052 are not contacted with the base plate 21.

From the above descriptions, the keyboard device 2 comprises the soft covering elements 23 and the buffering pads 24. The first hook parts 2042 and the second hook parts 2052 are separated from the base plate 21 through the soft covering elements 23 and the buffering pads 24. Even if all of the first stabilizer bar 204, the second stabilizer bar 205 and the base plate 21 are made of the metallic material, the drawbacks of the conventional technology will not be generated. Since the first hook parts 2042 and the second hook parts 2052 are not contacted with the base plate 21, the first hook parts 2042 and the second hook parts 2052 do not collide with the base plate 21 to generate the unpleasant noise. Consequently, the keyboard device 2 of the present invention is capable of reducing the noise.

Figure 12:
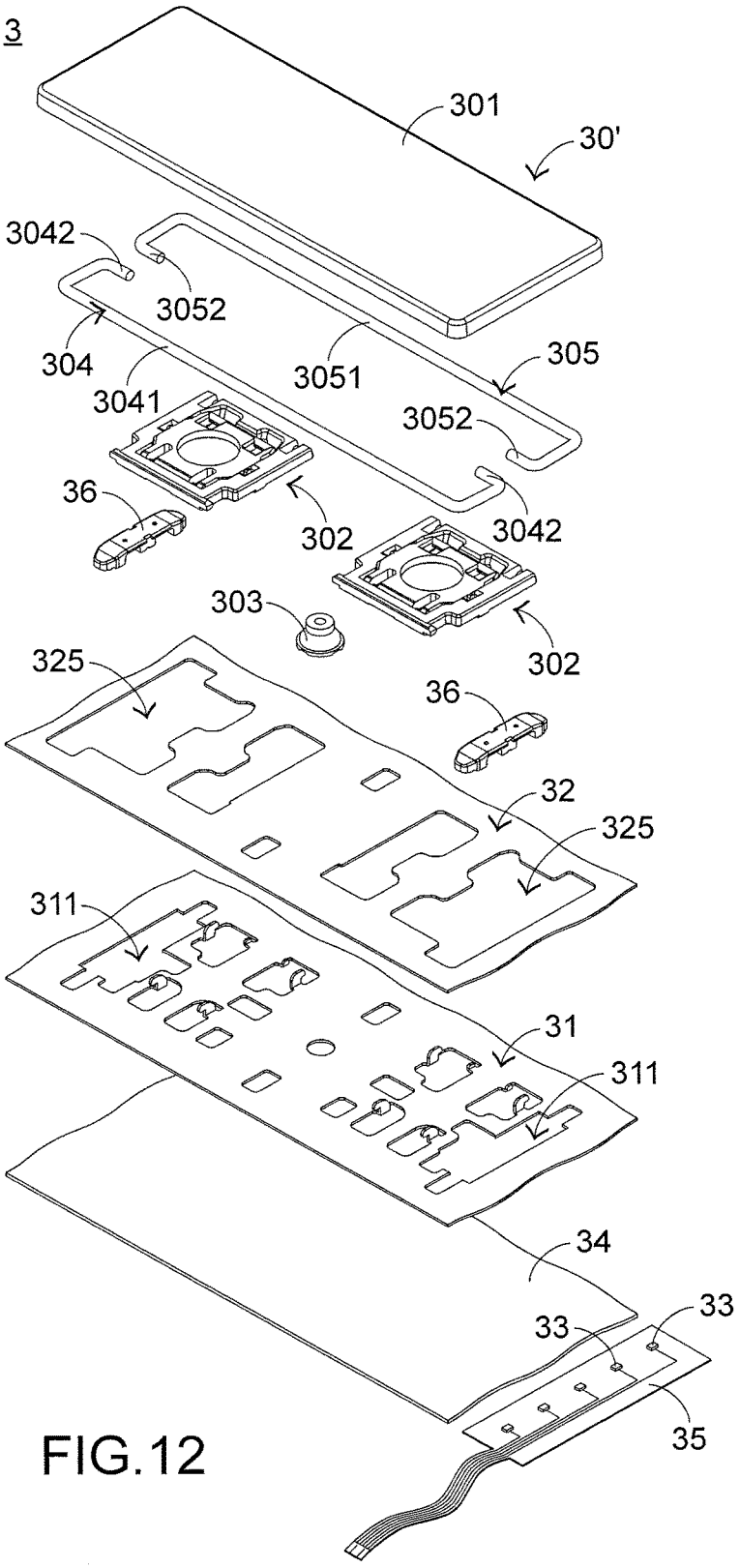
FIG. 12 is a schematic exploded view illustrating a portion of a keyboard device according to a second embodiment of the present invention and taken along a viewpoint.
Figure 13:
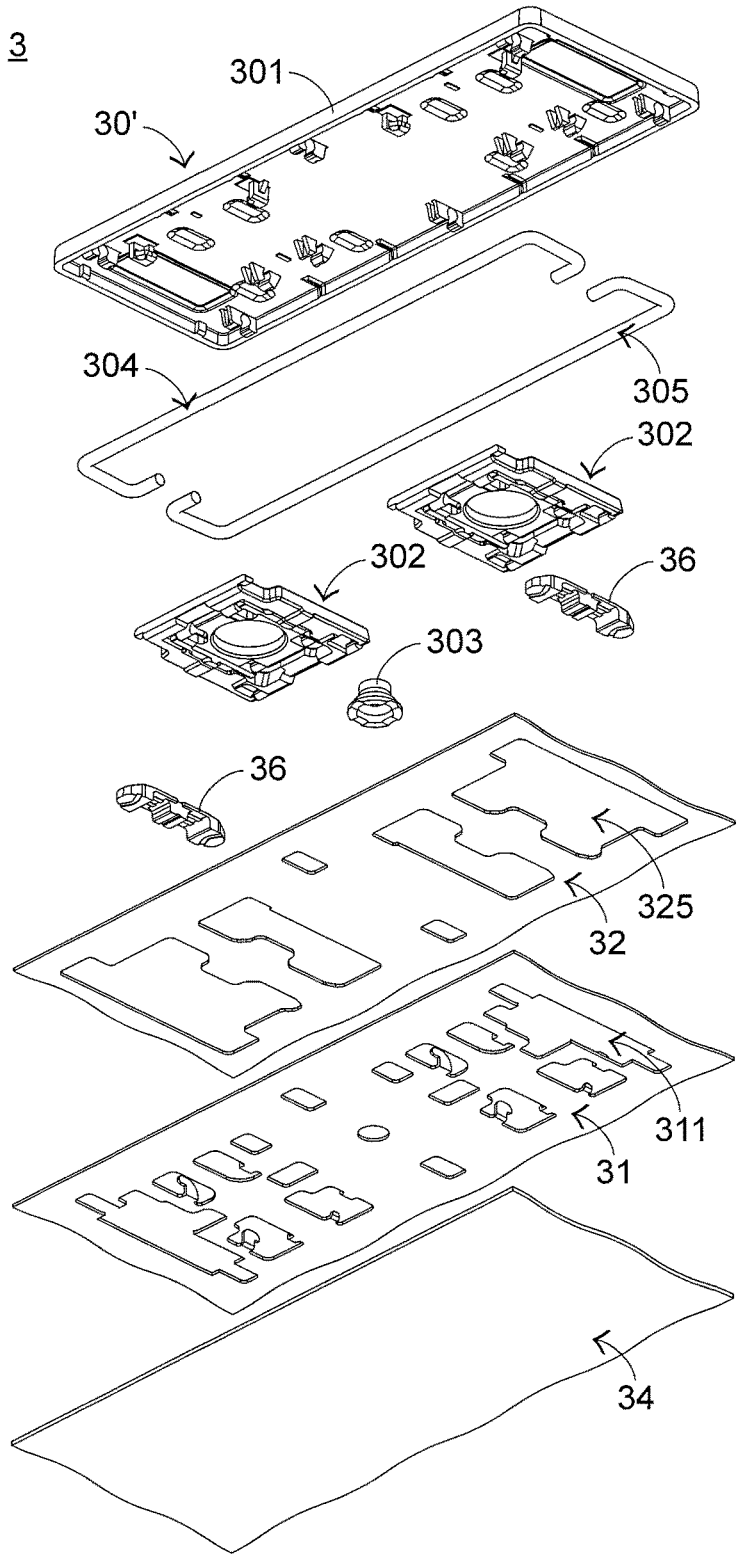
FIG. 13 is a schematic exploded view illustrating a portion of the keyboard device according to the second embodiment of the present invention and taken along another viewpoint.

The present invention further provides a keyboard device of a second embodiment, which is distinguished from the first embodiment. FIG. 12 is a schematic exploded view illustrating a portion of a keyboard device according to a second embodiment of the present invention and taken along a viewpoint. FIG. 13 is a schematic exploded view illustrating a portion of the keyboard device according to the second embodiment of the present invention and taken along another viewpoint. Please refer to FIGS. 12 and 13. In this embodiment, the keyboard device 3 comprises plural key structures 30', a base plate 31, a switch circuit board 32, plural light-emitting elements 33, a light guide plate 34, an illumination circuit board 35 and plural soft covering elements 36. Each of the key structures 30' comprises a keycap 301, at least one scissors-type connecting element 302, an elastic element 303, a first stabilizer bar 304 and a second stabilizer bar 305. The first stabilizer bar 304 comprises a first linking bar part 3041 and two first hook parts 3042. The second stabilizer bar 305 comprises a second linking bar part 3051 and two second hook parts 3052. In addition to an upper wiring plate (not shown), a lower wiring plate (not shown), a separation layer (not shown) and a key switch (not shown), the switch circuit board 32 further comprises plural first openings 325. Moreover, the base plate 31 further comprises plural second openings 311. Except for the following three items, the structures of the keyboard device 3 of this embodiment are substantially identical to those of the keyboard device 2 of the first embodiment, and are not redundantly described herein. Firstly, the keyboard device 3 further comprises the light-emitting elements 33, the light guide plate 34 and the illumination circuit board 35. Secondly, the structure of the soft coveting element 36 is distinguished from the soft covering element of the first embodiment. Thirdly, the structures of the base plate 31 and the switch circuit board 32 are distinguished.

Figure 14:
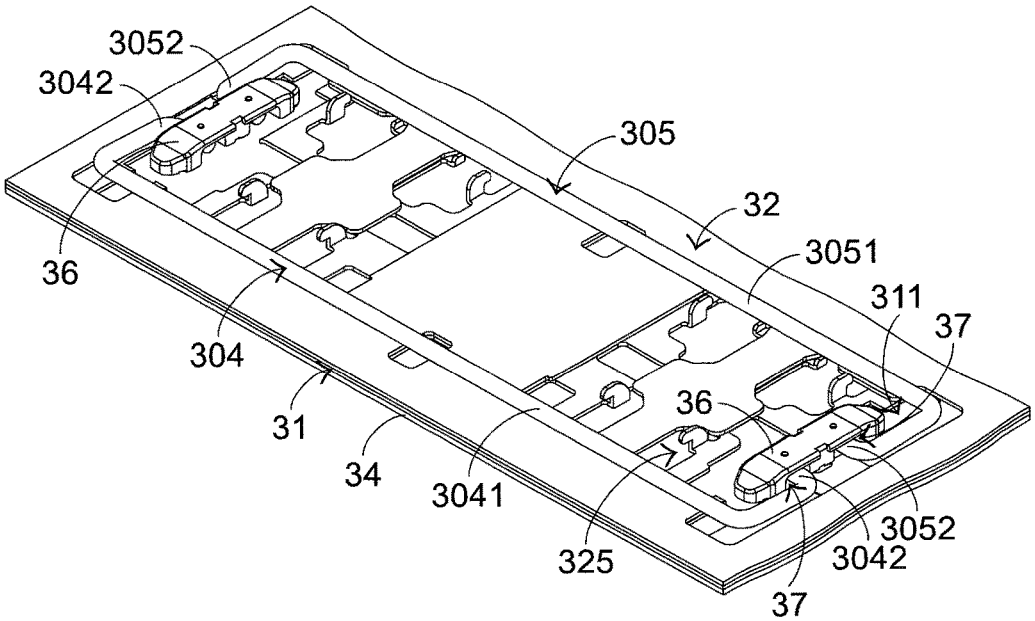
FIG. 14 is a schematic perspective view illustrating a portion of the combination of the light guide plate, the base plate and the switch circuit board of the keyboard device according to the second embodiment of the present invention.

FIG. 14 is a schematic perspective view illustrating a portion of the combination of the light guide plate, the base plate and the switch circuit board of the keyboard device according to the second embodiment of the present invention. Please refer to FIGS. 12, 13 and 14. The light guide plate 34 is located under the base plate 31. The light-emitting elements 33 are arranged beside the light guide plate 34. The light-emitting elements 33 emit light beams B. The illumination circuit board 35 is located below the base plate 31 and arranged beside the light guide plate 34. The light-emitting elements 33 are supported by the illumination circuit board 35. Moreover, the illumination circuit board 35 provides electric power to the light-emitting elements 33. Consequently, the light-emitting elements 33 are enabled.

As shown in FIGS. 12, 13 and 14, the soft covering elements 36 are disposed on the light guide plate 34. Moreover, plural accommodation spaces 37 are defined by the soft covering elements 36 and the light guide plate 34. The first hook parts 3042 and the second hook parts 3052 are inserted into the corresponding accommodation spaces 37. The soft covering elements 36 are adhered on a top surface of the light guide plate 34.

Moreover, the switch circuit board 32 further comprises the plural first openings 325 corresponding to the soft covering elements 36, and the base plate 31 further comprises the plural second openings 311 corresponding to the soft covering elements 36. As shown in FIG. 14, the soft covering elements 36 are sequentially penetrated through the corresponding second openings 311 and the corresponding first openings 325, and arranged between the base plate 31 and the keycaps 301. Consequently, the first hook parts 3042 and the second hook parts 3052 are inserted into the corresponding accommodation spaces 37.

In a preferred embodiment, the keyboard device further comprises plural buffering pads. The buffering pads are arranged between the top surface of the light guide plate and the accommodation spaces. Since the first hook parts and the second hook parts are not contacted with the light guide plate, the first hook parts and the second hook parts do not collide with the light guide plate to generate the unpleasant noise.

Figure 15:
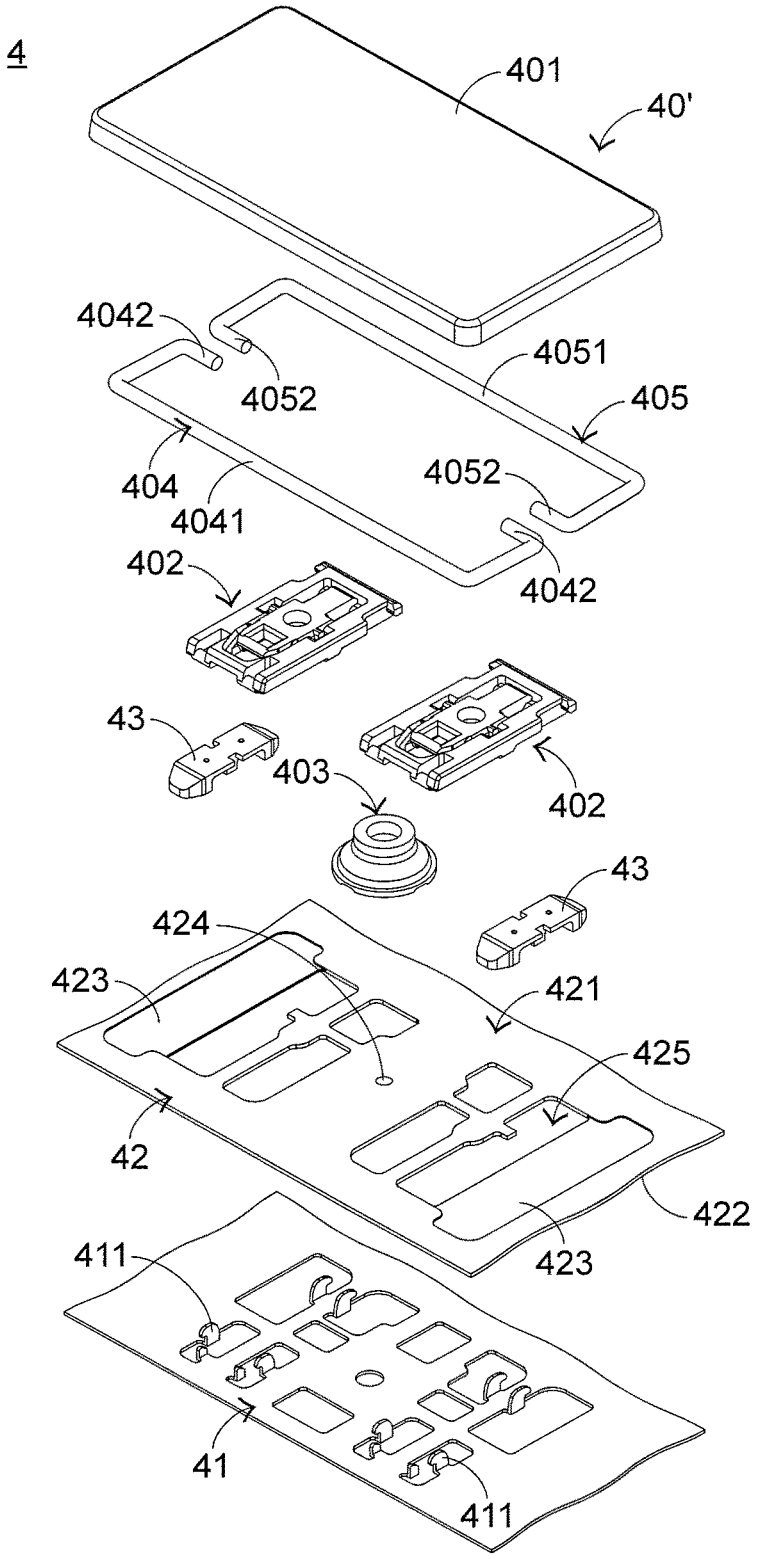
FIG. 15 is a schematic exploded view illustrating a portion of a keyboard device according to a third embodiment of the present invention.

The present invention further provides a keyboard device of a third embodiment, which is distinguished from the first embodiment. FIG. 15 is a schematic exploded view illustrating a portion of a keyboard device according to a third embodiment of the present invention. The keyboard device 4 comprises plural key structures 40', a base plate 41, a switch circuit board 42 and soft covering elements 43. Each of the key structures 40' comprises a keycap 401, at least one scissors-type connecting element 402, an elastic element 403, a first stabilizer bar 404 and a second stabilizer bar 405. The first stabilizer bar 404 comprises a first linking bar part 4041 and two first hook parts 4042, The second stabilizer bar 405 comprises a second linking bar part 4051 and two second hook parts 4052. The switch circuit board 42 comprises an upper wiring plate 421, a lower wiring plate 422, a separation layer 423, a key switch 424 and plural openings 425. Moreover, the base plate 41 further comprises plural base plate hooks 411. Except for the following item, the structures of the keyboard device 4 of this embodiment are substantially identical to those of the keyboard device 2 of the first embodiment, and are not redundantly described herein. In this embodiment, the soft covering elements 43 are disposed on the separation layer 423 of the switch circuit board 42.

In this embodiment, a top surface of the separation layer 423 of the switch circuit board 42 is partially exposed. Consequently, the soft covering elements 43 are adhered on the top surface of the separation layer 423. Moreover, the openings 425 of the switch circuit board 42 run through the upper wiring plate 421, the lower wiring plate 422 and the separation layer 423. The plural base plate hooks 411 are penetrated through the corresponding openings 425 and connected with the scissors-type connecting element 402. The switch circuit board 42 and the soft covering elements 43 are made of nonmetallic materials. Since the first hook parts and the second hook parts are separated from the base plate through the switch circuit board and the soft covering elements, the first hook parts and the second hook parts do not collide with the base plate to generate the unpleasant noise. It is noted that numerous modifications and alterations may be made while retaining the teachings of the invention. For example, in another embodiment, the soft covering elements are adhered on the top surface of the upper wiring plate of the switch circuit board. Under this circumstance, the efficacy of reducing noise is achieved.

From the above descriptions, the present invention provides the keyboard device. The soft covering elements are disposed on the top surface of the base plate or the light guide plate. The first hook parts and the second hook parts are separated from the base plate through the soft covering elements. The first coupling parts and the second coupling parts that are made of the metallic material and used in the conventional keyboard device are replaced by the soft covering elements according to the present invention. The soft covering elements are made of the soft material. Even if the first hook parts and the second hook parts are made of the metallic material, the first hook parts and the second hook parts are only contacted with the soft covering elements but not contacted with the metallic material. That is, the metallic components do not collide with the base plate to generate the unpleasant noise. Consequently, the keyboard device of the present invention is capable of reducing the noise.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a key structure comprising a keycap and a stabilizer bar, wherein the keycap is exposed outside the keyboard device, the stabilizer bar is connected with the keycap, and comprises a linking bar part and a hook part, wherein the linking bar part is connected with the keycap, and the hook part is located at an end of the linking bar part;

a switch circuit board located under the key structure, wherein when the switch circuit board is triggered, a key signal is generated;

a base plate located under the switch circuit board, and supporting the key structure;

a soft covering element disposed on the base plate, wherein an accommodation space is defined by the soft covering element and the base plate collaboratively, and the hook part is inserted into the accommodation space, so that the hook part is permitted to be moved within the accommodation space; and a buffering pad disposed on the base plate and partially received within the accommodation space, wherein the hook part and the base plate are separated from each other through the buffering pad.

2. The keyboard device according to claim 1, wherein the switch circuit board comprises:

an upper wiring plate comprising an upper circuit pattern, wherein the upper circuit pattern is formed on a bottom surface of the upper wiring plate;

a lower wiring plate located under the upper wiring plate, and comprising a lower circuit pattern, wherein the lower circuit pattern is formed on a top surface of the lower wiring plate; and a separation layer arranged between the upper wiring plate and the lower wiring plate, and comprising a perforation, wherein the upper circuit pattern and the lower circuit pattern are separated from each other through the separation layer, and a key switch is defined by the upper circuit pattern, the perforation and the lower circuit pattern collaboratively.

3. The keyboard device according to claim 1, wherein the switch circuit board further comprises an opening corresponding to the soft covering element, wherein the soft covering element is penetrated through the opening, so that the hook part is inserted into the accommodation space.

4. The keyboard device according to claim 1, wherein the soft covering element is adhered on a top surface of the base plate, the accommodation space is a through-hole, and the hook part is penetrated through the through-hole.

5. The keyboard device according to claim 1, wherein the soft covering element is made of silicone resin or a soft plastic material.

6. A keyboard device, comprising: a key structure comprising a keycap and a stabilizer bar, wherein the keycap is exposed outside the keyboard device, the stabilizer bar is connected with the keycap, and comprises a linking bar part and a hook part, wherein the linking bar part is connected with the keycap, and the hook part is located at an end of the linking bar part; a switch circuit board located under the key structure, wherein when the switch circuit board is triggered, a key signal is generated; a base plate located under the switch circuit board, and supporting the key structure; a light-emitting element emitting a light beam; a light guide plate located under the base plate and arranged beside the light-emitting element, wherein the light beam is guided to the key structure by the light guide plate; a soft covering element disposed on the light guide plate, wherein an accommodation space is defined by the soft covering element and the light guide plate collaboratively, and the hook part is inserted into the accommodation space, so that the hook part is permitted to be moved within the accommodation space; and a buffering pad, wherein the buffering pad is disposed on the light guide plate and partially received within the accommodation space, and the hook part and the light guide plate are separated from each other through the buffering pad.

7. The keyboard device according to claim 6, wherein the switch circuit board comprises a first opening corresponding to the soft covering element, and the soft covering element is penetrated through the first opening, wherein the base plate comprises a second opening corresponding to the soft covering element, and the soft covering element is penetrated through the second opening, wherein the soft covering element is penetrated through the second opening and the first opening, so that the hook part is inserted into the accommodation space.

8. The keyboard device according to claim 6, wherein the soft covering element is adhered on a top surface of the light guide plate, the accommodation space is a through-hole, and the hook part is penetrated through the through-hole.

9. The keyboard device according to claim 6, wherein the key structure further comprises:

a scissors-type connecting element connected with the keycap and the base plate, wherein the keycap is fixed on the base plate through the scissors-type connecting element, so that the keycap is movable relative to the base plate; and an elastic element arranged between the keycap and the switch circuit board, wherein when the elastic element is pushed by the keycap, the switch circuit board is triggered by the elastic element, wherein when the elastic element is not pushed by the keycap, the elastic element provides an elastic force to the keycap.

* * * * *